US009375066B1

(12) United States Patent
Velazquez et al.

(10) Patent No.: US 9,375,066 B1
(45) Date of Patent: Jun. 28, 2016

(54) RING BOX WITH ROTATING RING HOLDER

(71) Applicants: Marvin Velazquez, Torrance, CA (US); Mark Walker, Fullerton, CA (US)

(72) Inventors: Marvin Velazquez, Torrance, CA (US); Mark Walker, Fullerton, CA (US)

( * ) Notice: Subject to any disclaimer, the term of this patent is extended or adjusted under 35 U.S.C. 154(b) by 0 days.

(21) Appl. No.: 14/603,249

(22) Filed: Jan. 22, 2015

(51) Int. Cl.
*A45C 11/16* (2006.01)
*A45C 13/02* (2006.01)
*B65D 43/22* (2006.01)

(52) U.S. Cl.
CPC ..... *A45C 11/16* (2013.01); *A45C 13/02* (2013.01); *B65D 43/22* (2013.01)

(58) Field of Classification Search
CPC ..... A45C 11/16; A47F 7/03; A47F 7/02
USPC ..... 206/6.1, 755, 754, 751, 752, 566, 559, 206/251; 211/85.2
See application file for complete search history.

(56) References Cited

U.S. PATENT DOCUMENTS 1,960,073 A 5/1934 Warner
2,196,688 A 4/1940 Warner et al.
2,647,623 A * 8/1953 Ortendahl ..... A45C 11/12 206/6.1
2,647,624 A * 8/1953 Sedgwick ..... A45C 11/10 206/6.1
2,755,921 A * 7/1956 Ortendahl ..... A45C 11/10 206/6.1
2,991,876 A * 7/1961 Shiffman ..... A45C 11/16 206/6.1
3,003,619 A 10/1961 Samuels
3,353,657 A * 11/1967 Young ..... A45C 11/24 206/755
3,937,319 A 2/1976 Roy
5,692,605 A * 12/1997 Lai ..... A45C 13/02 206/566
5,979,661 A 11/1999 Sherman et al.
6,513,672 B1 2/2003 Ovadia
8,522,964 B1 * 9/2013 Pledger ..... A47F 7/03 206/523
9,084,462 B2 * 7/2015 Michael ..... A45C 11/16
2010/0181227 A1 7/2010 Tolkowsky
2014/0175091 A1 * 6/2014 Michael ..... A45C 11/16 220/4.22

FOREIGN PATENT DOCUMENTS

DE 20-2009-000-515 5/2009

* cited by examiner

*Primary Examiner* — Steven A. Reynolds
(74) *Attorney, Agent, or Firm* — West & Associatesm A PC; Stuart J. West; Shaun N. Sluman

(57) ABSTRACT

A ring box having a rotating ring holder, wherein movement of one or more lids as the ring box is opened or closed drives rotation of the ring holder. In some embodiments the depth of the ring box in its closed configuration can be substantially similar to the depth of the ring holder.

12 Claims, 15 Drawing Sheets

RING BOX WITH ROTATING RING HOLDER

BACKGROUND

1. Field of the Invention

The present disclosure relates to ring boxes, particularly a ring box having a rotating ring holder.

2. Background

Ring boxes have traditionally been used to store and/or present engagement rings, wedding rings, or other rings or jewelry. Most ring boxes have a base with a single static slot into which a ring can be inserted, and a lid that can be closed to enclose the ring inside the ring box.

The dimensions of most conventional ring boxes are much larger than the rings they hold. As such, they can be bulky and are not easily held in pockets, which can present a problem when it is desired to keep the existence of a ring box a secret. For example, many people who plan to propose marriage wish to make the proposal a surprise to their significant other, but run the risk of having the surprise ruined by carrying around an engagement ring in a ring box that may be easily detected in a pocket due to its bulk. Some choose to avoid using a ring box for this reason and instead keep an engagement ring loose in their pocket prior to a proposal, but this presents further problems as the ring can be easily lost when it is loose and not stored in a box or case.

Standard ring boxes can also be perceived as being bland or boring, especially next to the rings inside them. Although some ring boxes are decorated with velvet, silk linings or other aesthetic features, they essentially remain standard boxes without any features that might surprise a viewer or recipient.

What is needed is a box that is thin enough to hold a ring and fit within a pocket without adding much extra bulk, and that has a rotating ring holder that spins as the ring box is opened and closed. The rotating ring holder can augment a marriage proposal or any other ring presentation, because the recipient may become surprised or impressed when the ring box is opened and the ring rotates during its unveiling.

DETAILED DESCRIPTION

Figure 1A:
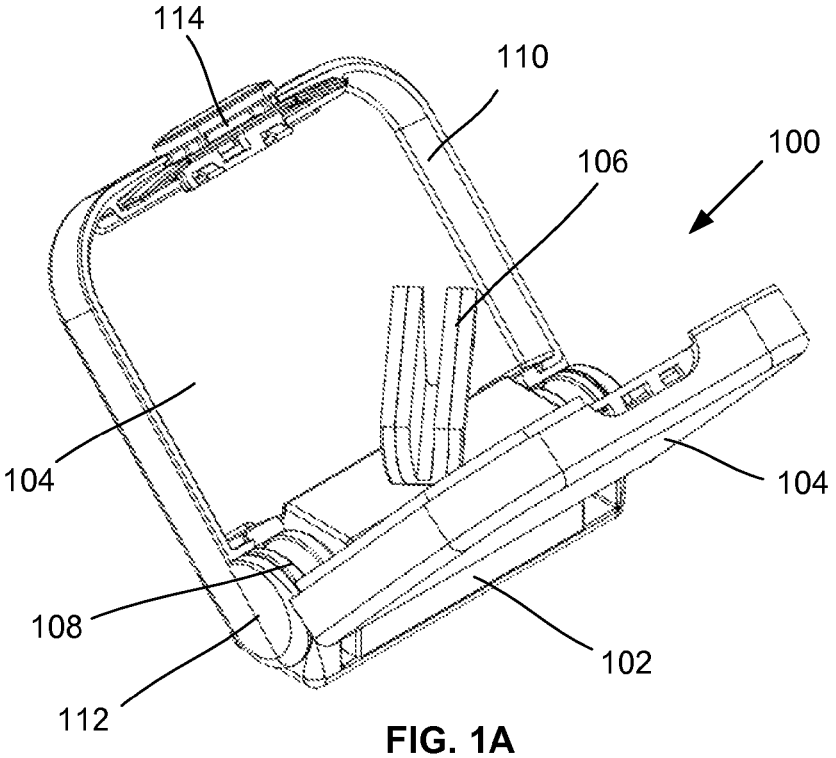
FIG. 1A depicts a first embodiment of a ring box in an opened configuration.
Figure 1B:
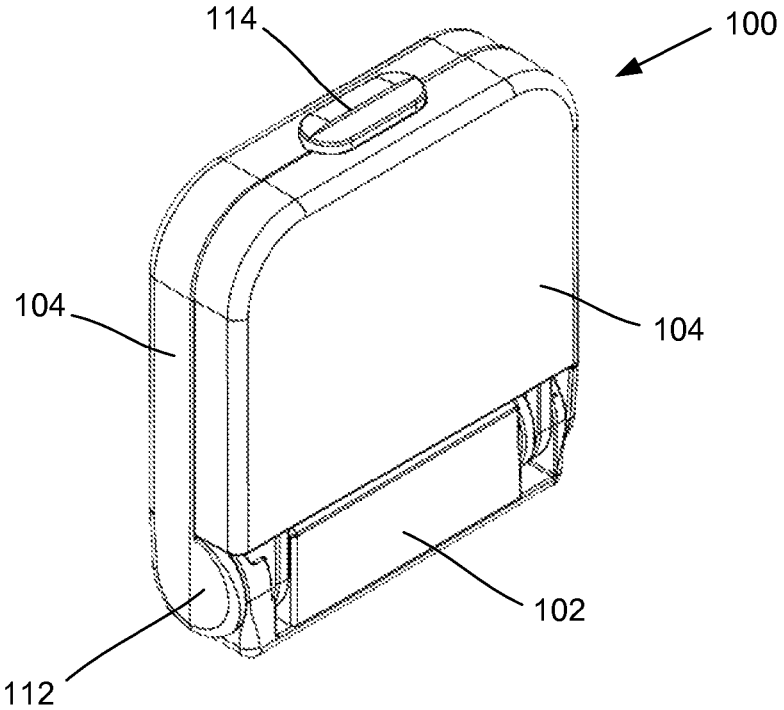
FIG. 1B depicts the first embodiment of a ring box in a closed configuration.
Figure 1C:
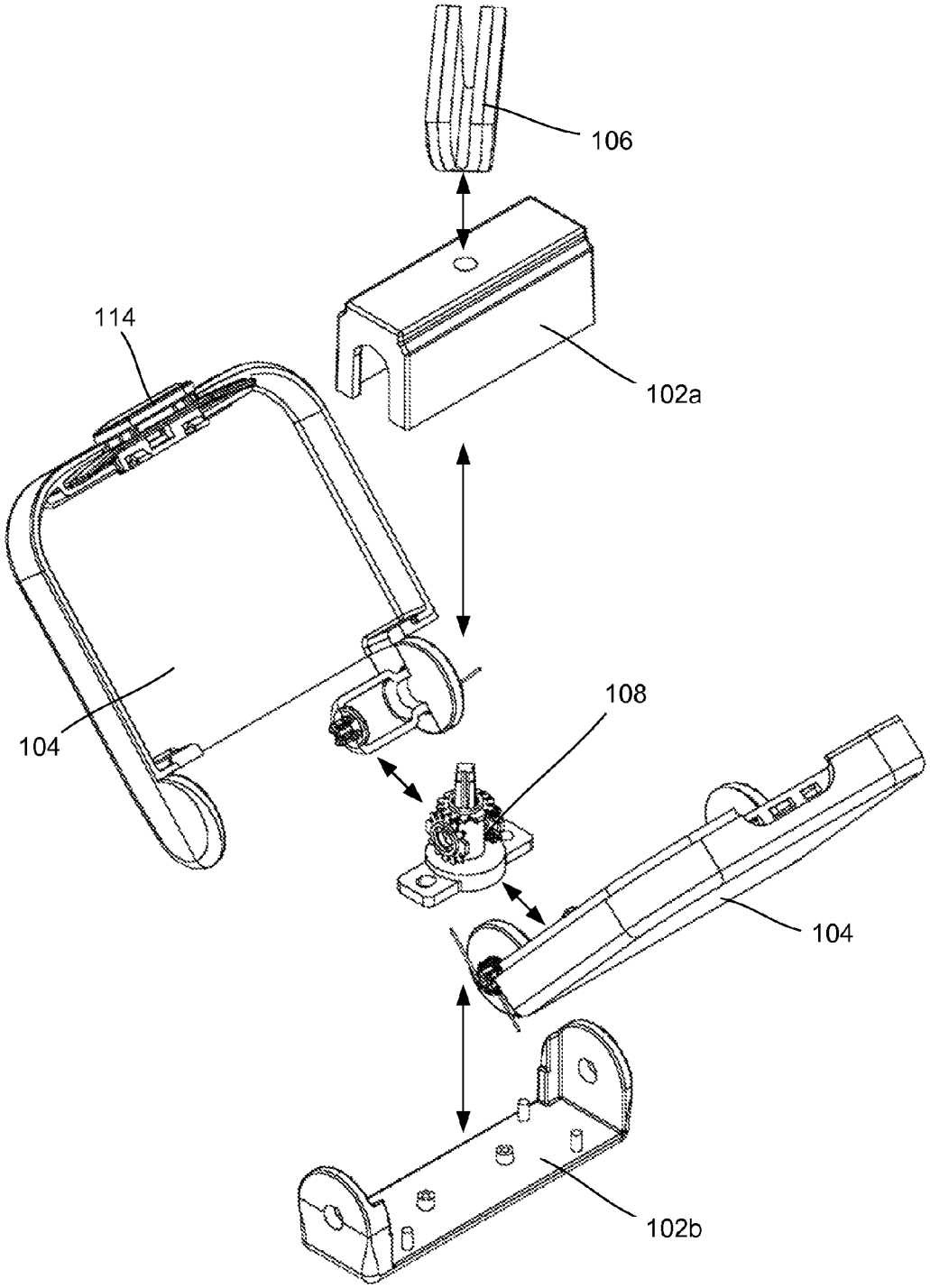
FIG. 1C depicts an exploded view of the first embodiment of a ring box.

A ring box 100 can comprise a base 102, one or more lids 104 rotationally coupled with the base 102, a ring holder 106, and a rotational mechanism 108 configured to rotate the ring holder 106 as the ring box 100 is opened or closed. FIG. 1A depicts a first embodiment of a ring box 100 in an opened configuration. FIG. 1B depicts the first embodiment of a ring box 100 in a closed configuration. FIG. 1C depicts an exploded view of the first embodiment of a ring box 100.

One or more lids 104 can be rotationally coupled with a base 102 such that the lids 104 can be moved relative to the base 102 to open or close the ring box 100, thereby revealing or concealing a ring holder 106 and/or a ring held by the ring holder 106. The lids 104 can be covers, flaps, panels, shells, or other members. Side walls 110 can extend around at least some portions of the periphery of the lids 104, such that the side walls 110 can meet and/or overlap when the ring box 100 is closed, thereby enclosing the interior of the ring box 100 as shown in FIG. 1B.

Figure 9A:
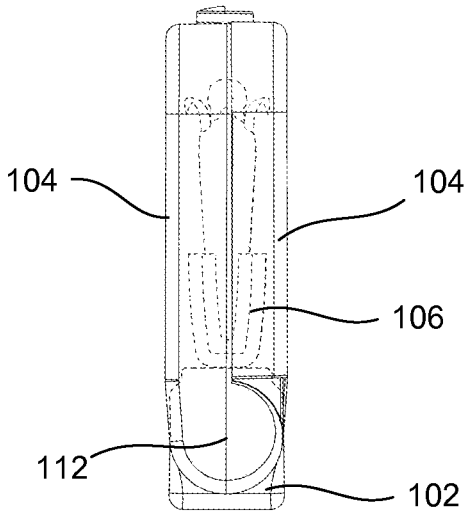
FIG. 9A-9C depict the progression of an embodiment of a ring box as it is opened from a closed configuration to an open configuration.

The height, width, and depth of the ring box 100 in its closed configuration can be large enough to hold most rings, such as engagement-style rings, inside an enclosure formed by the base 102 and lids 104. However, in some embodiments the height, width, and depth of the ring box 100 in its closed configuration can be sized such that there is not significant space between a ring or ring holder and the interior walls of the ring box 100, as shown in FIG. 9A. The ring box 100 can be sized to snugly hold most ring styles, without adding significant bulk beyond the dimensions of the ring itself. By way of a non-limiting example, the depth of the ring holder 106 can be larger than, but substantially similar to a ring, and the space between opposing interior faces of the lids 104 when the ring box 100 is closed can be larger than, but substantially similar to, the depth of the ring holder 106 when the ring holder 106 is rotated to fit within the closed ring box 100.

Figure 10A:
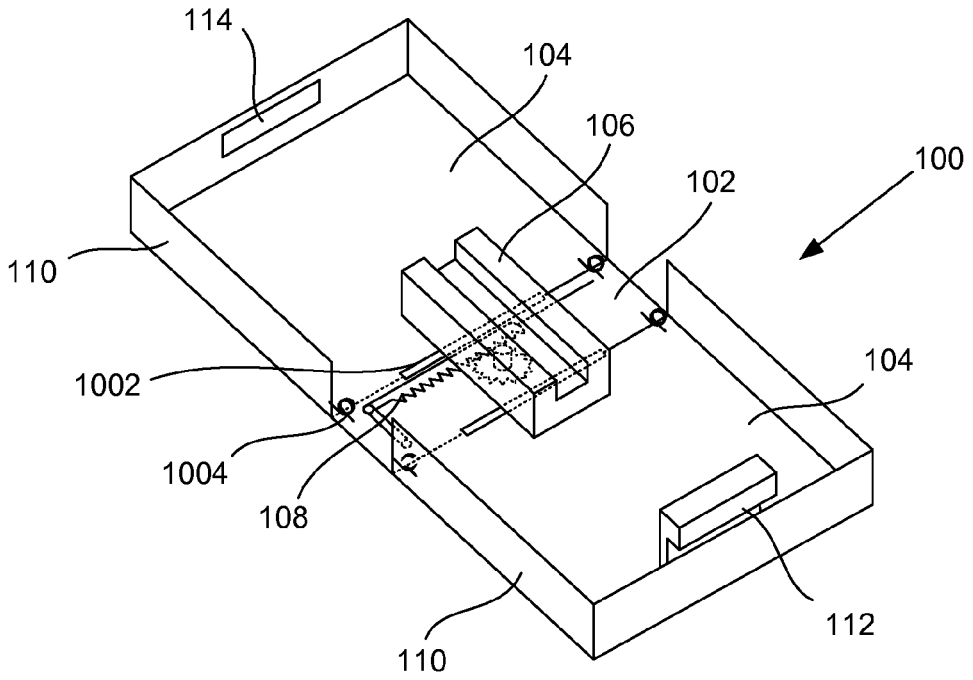
FIG. 10A depicts a second embodiment of a ring box in an opened configuration.
Figure 10B:
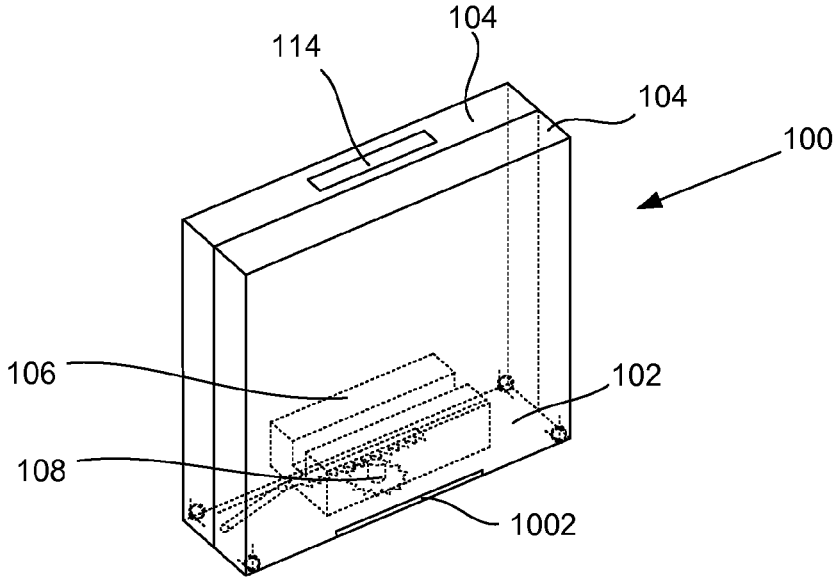
FIG. 10B depicts the second embodiment of a ring box in a closed configuration.
Figure 11A:
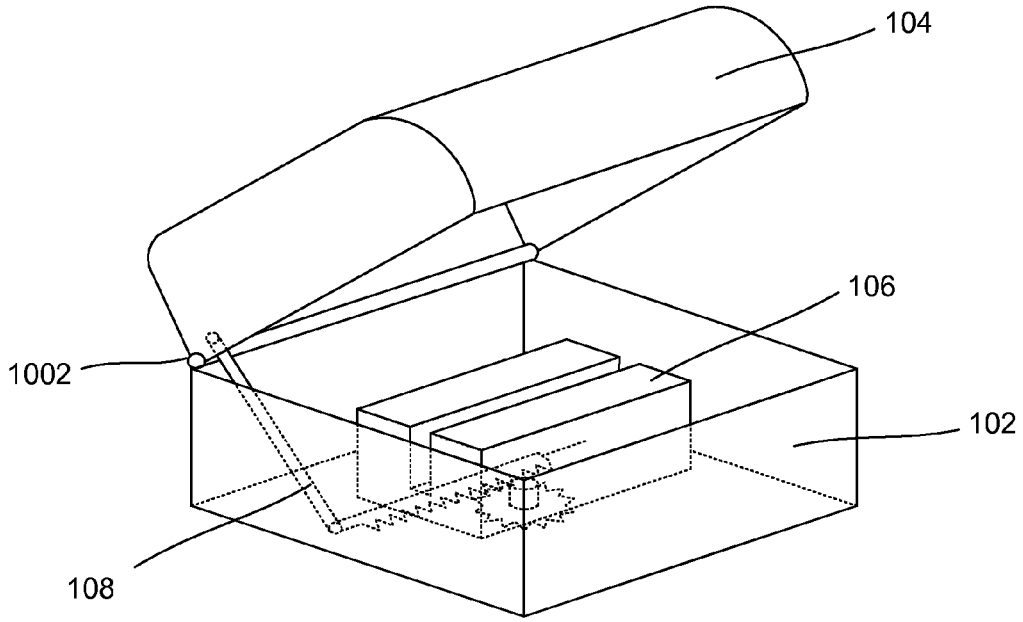
FIG. 11A depicts a third embodiment of a ring box in an opened configuration.
Figure 11B:
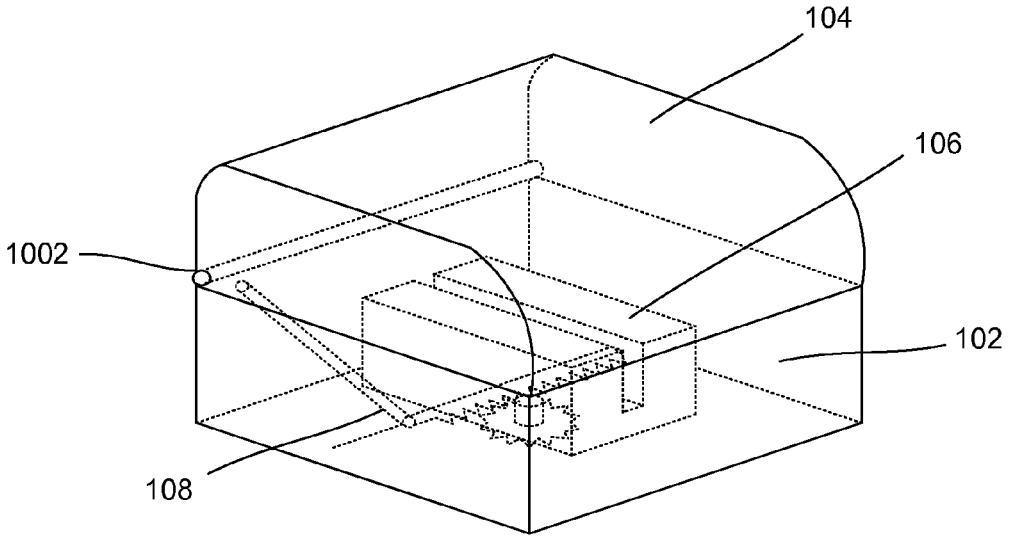
FIG. 11B depicts the third embodiment of a ring box in a closed configuration.

In some embodiments, two lids 104 can be coupled on opposing sides of the base 102 such that the lids 104 can be moved apart to open the ring box 100 as shown in FIG. 1A and FIG. 10A, or be moved together to close the ring box 100 as shown in FIG. 1B and FIG. 10B. In other embodiments, the ring box 100 can have a single lid 104 that can be moved to entirely cover the base 102, as shown in FIGS. 11A-11B. In still other embodiments, the ring box 100 can have any other number of lids 104.

In some embodiments, the lids 104 can have extending portions that interconnect with elements of the base 102 to form an axle joint 112 that allows the lids 104 to rotate about an axis proximate to the base 102, as will be discussed below with respect to FIGS. 4-9. In other embodiments, the lid 104 can be coupled with the base 102 via one or more hinges 1002 along edges of the lid 104 and/or base 102, as will be discussed below with respect to FIGS. 10-13. In alternate embodiments, the base 102 and one or more lids 104 can be contiguous, and the lids 104 can be bendable relative to the base 102 at a flexure bearing, crease or joint.

Figure 2:
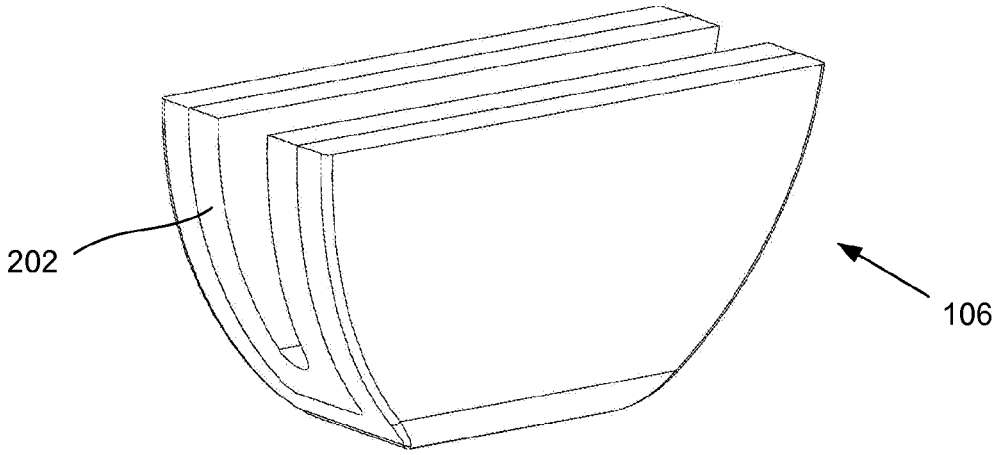
FIG. 2 depicts an embodiment of a ring holder.
Figure 3:
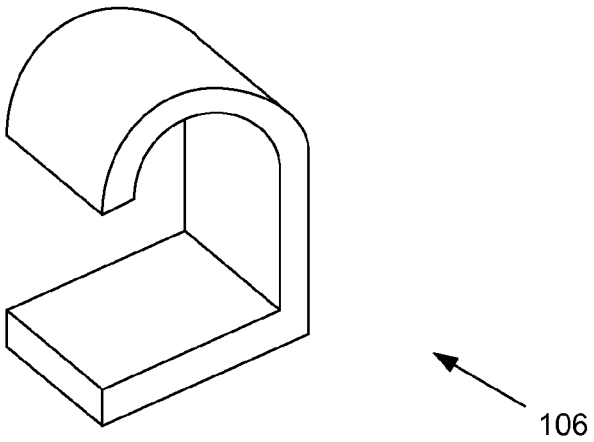
FIG. 3 depicts an alternate embodiment of a ring holder.

The ring holder 106 can be configured to receive and hold at least a portion of a ring, such as a diamond engagement ring, wedding band, or any other type of ring. The ring holder 106 can have a groove, hook, clamp, clasp, stand, or any other attachment mechanism configured to retain at least a portion of a ring. By way of a non-limiting example, in some embodiments the ring holder 106 can be a grooved block as shown in FIG. 2. By way of another non-limiting example, in some embodiments the ring holder 106 can be a hook, as shown in FIG. 3. By way of yet another non-limiting example, in some embodiments the ring holder 106 can be an elongated protrusion with a shape and size similar to a human finger, such that a ring can be placed around the elongated protrusion as it would be placed around a finger. In some embodiments, the ring holder 106 can be at least partially lined with a soft or padded material to assist in protecting rings inserted into it and/or assist in retaining the ring. By way of a non-limiting example, the ring holder 106 shown in FIG. 2 has a foam lining 202 within its groove. The ring holder 106 can be positioned within the ring box 100 such that the ring holder 106 is inside the interior of the ring box 100 when the ring box 100 is closed, and such that the ring holder 106 and/or a ring held by the ring holder 106 is exposed when the ring box 100 is opened.

The ring holder 106 can be coupled with a rotational mechanism 108 on or within the base 102. The rotational mechanism 108 can also be directly or indirectly coupled with at least one of the lids 104, such that the action of moving the lid 104 to open or close the ring box 100 drives the rotational mechanism 108 to at least partially rotate the ring holder 106. By way of a non-limiting example, the ring holder 106 and/or a ring held by the ring holder 106 can be oriented to fit within the interior of the ring box 100 when the ring box 100 is closed, but be at least partially rotated relative to the base as the lids 104 are opened.

The rotational mechanism 108 can be configured to rotate the ring holder 106 by a quarter turn, half turn, three quarters turn, full turn, more than a full turn, or any other degree of rotation as the ring box 100 is moved between a closed position and a fully open position. In some embodiments, the rotational mechanism 108 can be configured to begin rotating the ring holder 106 as soon as one or more lids 104 are moved relative to the base 102. In other embodiments, the rotational mechanism 108 can be configured to begin rotating the ring holder 106 when a lid 104 has been moved to a preset position relative to the base 102, such as when the ring box 100 has been opened halfway. The rotational mechanism 108 can comprise one or more gears, threaded rods, coils, springs, motors, pulleys, and/or any other component or combination of components configured to rotate the ring holder 106 as the ring box 100 is being opened or closed. In some embodiments, movement of one or more lids 104 relative to the base 102 can be translated by the rotational mechanism 108 into rotational movement of the ring holder 106. In alternate embodiments the rotational mechanism 108 can be at least partially motorized, and the movement of one or more lids 104 relative to the base 102 can trigger activation of a motor that rotates the ring holder 106.

The base 102, lids 104, and/or ring holder 106 can comprise substantially rigid material such as wood, plastic, metal, cardboard, polystyrene foam, or any other desired material. In some embodiments the base 102, lids 104, and/or ring holder 106 can have interior and/or exterior linings and/or padding, such as velvet, silk, leather, cloth, satin, suede, foam, or any other desired material. Further, in some embodiments the base 102, lids 104, and/or ring holder 106 can have decorative elements such as lights, reflective surfaces, luminous paint, or any other decorative or aesthetic feature. By way of a non-limiting example, in some embodiments the base 102 can comprise an LED (light-emitting diode), a battery, and wiring such that the LED is configured to illuminate when the ring box 100 is opened.

In some embodiments the lids 104 and/or base 102 can have one or more locking mechanisms 114 that, when engaged, can maintain the ring box 100 in its closed configuration, such as a latch, clasp, snaps, magnetic connectors, or any other mechanism. In some embodiments, a latch or other locking mechanism 114 can be spring-loaded such that one or more springs or tension devices within the locking mechanism 114 push the locking mechanism 114 into place to lock the ring box 100 when the ring box 100 is in its closed configuration, but allow the locking mechanism 114 to be depressed to release the locking mechanism 114 and allow the ring box 100 to be opened. By way of a non-limiting example, FIGS. 1A-1C depict a latch on one lid 104 that can engage with a corresponding portion of the other lid 104 to keep the ring box 100 closed, and that can be disengaged when pressed to allow the ring box 100 to be opened. In some embodiments, the locking mechanism 114 can be shaped to indicate to a user which side of the locking mechanism 114 is permanently coupled to a lid 104 and which side is detachable from the other lid 104 or the base 102. By way of a non-limiting example, a latch can have an asymmetric shape such that its asymmetry can identify one side as detachable from a lid 104. In other embodiments, a latch or any other type of the locking mechanism 114 can be substantially symmetric, or can have any other shape or design. In still further embodiments, locking mechanisms 114 can be absent.

Figure 4:
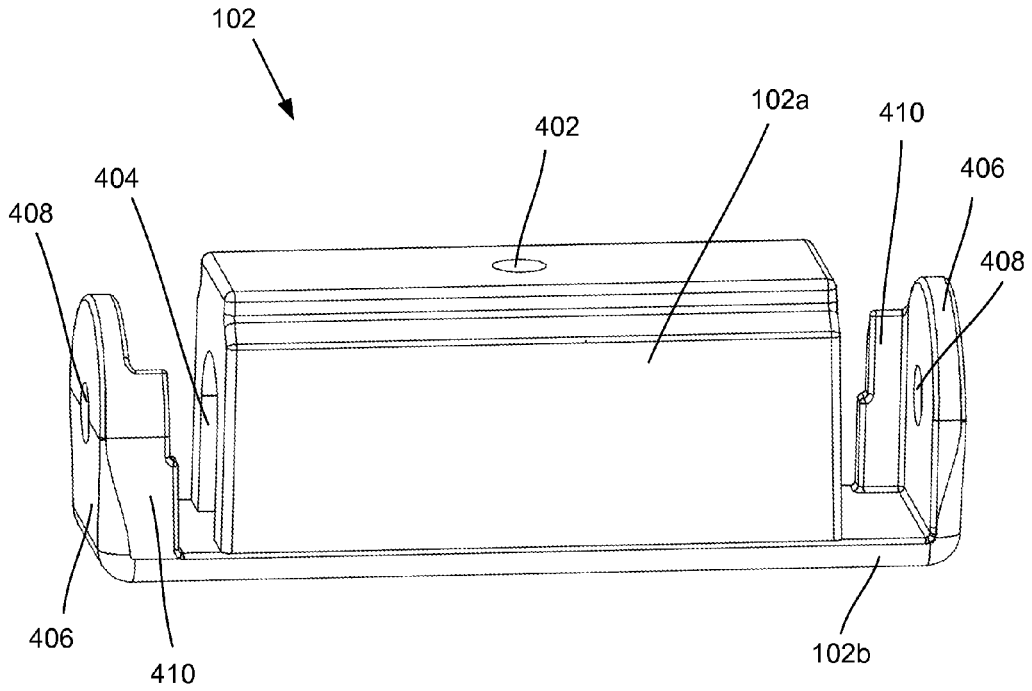
FIG. 4 depicts an exemplary embodiment of a base.

FIG. 4 depicts an exemplary embodiment of a base 102. In some embodiments, the base 102 can comprise an upper base housing **102*a* and a lower base housing 102*b*, as shown in FIG. 4 and in the exploded view of FIG. 1C. In these embodiments, the upper base housing 102*a* and lower base housing 102*b* can together define a hollow interior such that the base 102 can surround extending portions of the lids 104 and/or the rotational mechanism 108. By way of a non-limiting example, FIG. 1C shows that the rotational mechanism 108 can be housed within the base 102 formed by the upper base housing 102*a* and lower base housing 102*b*. In alternate embodiments, the base 102** can be flat, substantially planar, or have any other shape or structure.

As shown in FIG. 4, in embodiments with an upper base housing **102*a* and lower base housing 102*b*, the upper base housing 102*a* and/or lower base housing 102*b* can have one or more apertures, openings, slots, or cut-outs through which other portions of the ring box 100 can extend into the hollow interior of the base 102. By way of a non-limiting example, the upper base housing 102*a* can have an axle shaft hole 402 on its top and side slots 404 on opposing sides. The lower base housing 102*b* can have end walls 406 extending proximate to opposing ends of the lower base housing 102*b*. In some embodiments, the end walls 406 can be spaced farther apart than the length of the upper base housing 102*a*, such that gaps exist between the sides of the upper base housing 102*a* and the end walls 406 of the lower base housing 102*b* as shown in FIG. 4. As will be discussed below, these gaps can be filled with extending portions of the lids 104 as part of an axle joint 112. The end walls 406 can define axle connections 408 that can be coupled with other components of an axle joint 112. By way of a non-limiting example, the axle connections 408 can be holes extending through the end walls 406. In some embodiments, each end wall 406 can further have a spring cover 410 extending out of the end wall 406 along an edge of the lower base housing 102***b*.

Figure 5:
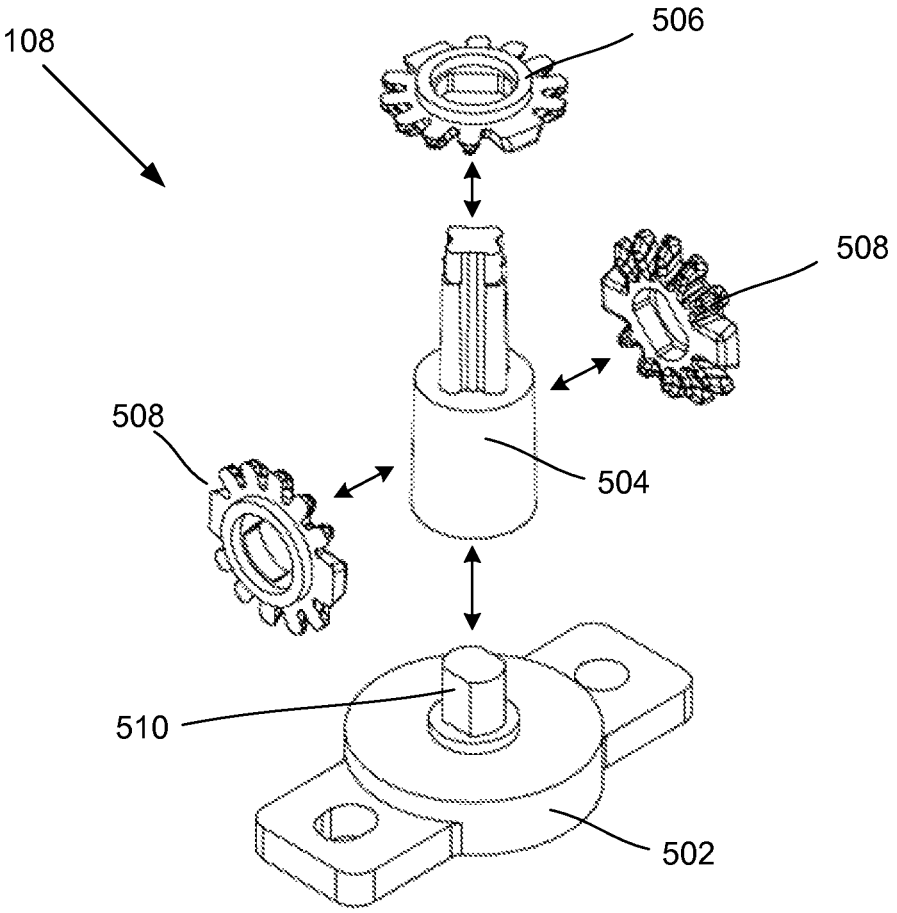
FIG. 5 depicts an exploded view of an exemplary embodiment of a rotational mechanism.

FIG. 5 depicts an exploded view of an exemplary embodiment of a rotational mechanism 108. In some embodiments a rotational mechanism 108 can comprise a pedestal 502, an axle shaft 504, an axle gear 506, and one or more lid gears 508. The pedestal 502 can be coupled with the base 102, such as being affixed to the lower base housing 102*b*. The pedestal 502 can have a pedestal protrusion 510 that can be inserted into an open end of the axle shaft 504, such that the axle shaft 504 can rotate around the pedestal protrusion 510. The axle gear 506 can be coupled with the axle shaft 504 such that the axle gear 506 rotates with the axle shaft 504. By way of a non-limiting example, at least a portion of the axle shaft 504 can have notches or be otherwise shaped to match an interior opening in the axle gear 506.

The rotational mechanism 108 can further comprise one or more lid gears 508 configured to be coupled with components of the lids 104, such that movement of the lids 104 drives movement of the lid gears 508. The lid gears 508 can have teeth that interact with teeth in the axle gear 506, such that rotation of the lid gears 508 drives rotation of the axle gear 506, and in turn rotation of the axle shaft 504. The ring holder 106 can be coupled with the top of the axle shaft 504, such that the ring holder 106 rotates along with the axle shaft 504 when the lids 104 are opened or closed. In some embodiments the top of the axle shaft 504 can extend through the axle shaft hole 402 of the upper base housing 102*a*, such that the ring holder 106 is coupled with the top of the axle shaft 504 above the upper base housing 102*a* while the axle gear 506 is within the interior of the base 102.

In embodiments with two or more lid gears 508, movement of one lid 104 can drive rotation of a first lid gear 508 to drives rotation of the axle gear 506 and axle shaft 504, and the rotation of the axle gear 506 can in turn drive rotation of a second lid gear 508 to rotate a second lid 104 coupled with the second lid gear 508. As such, in some embodiments the movement of one lid 104 can translate into mirrored corresponding movement of a second lid 104.

Figure 6:
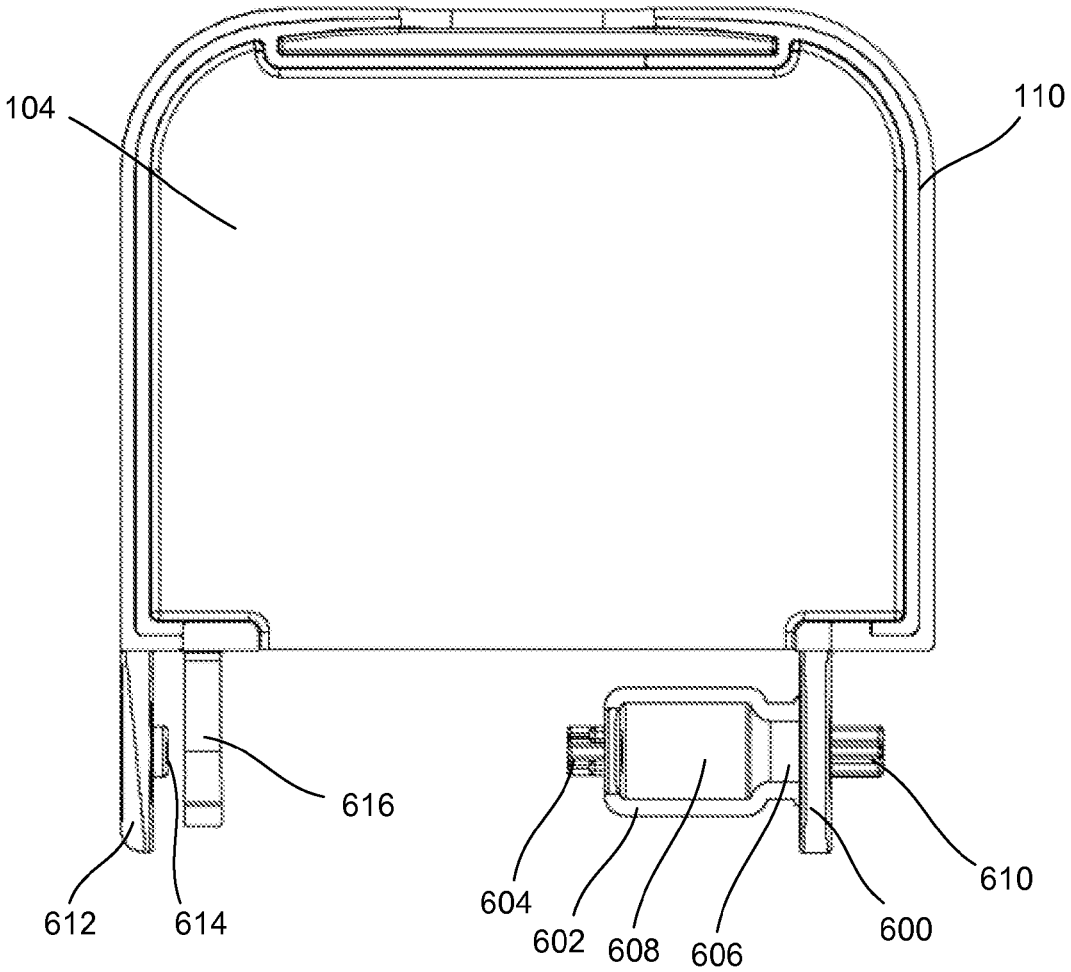
FIG. 6 depicts a side view of an exemplary embodiment of a lid.
Figure 7:
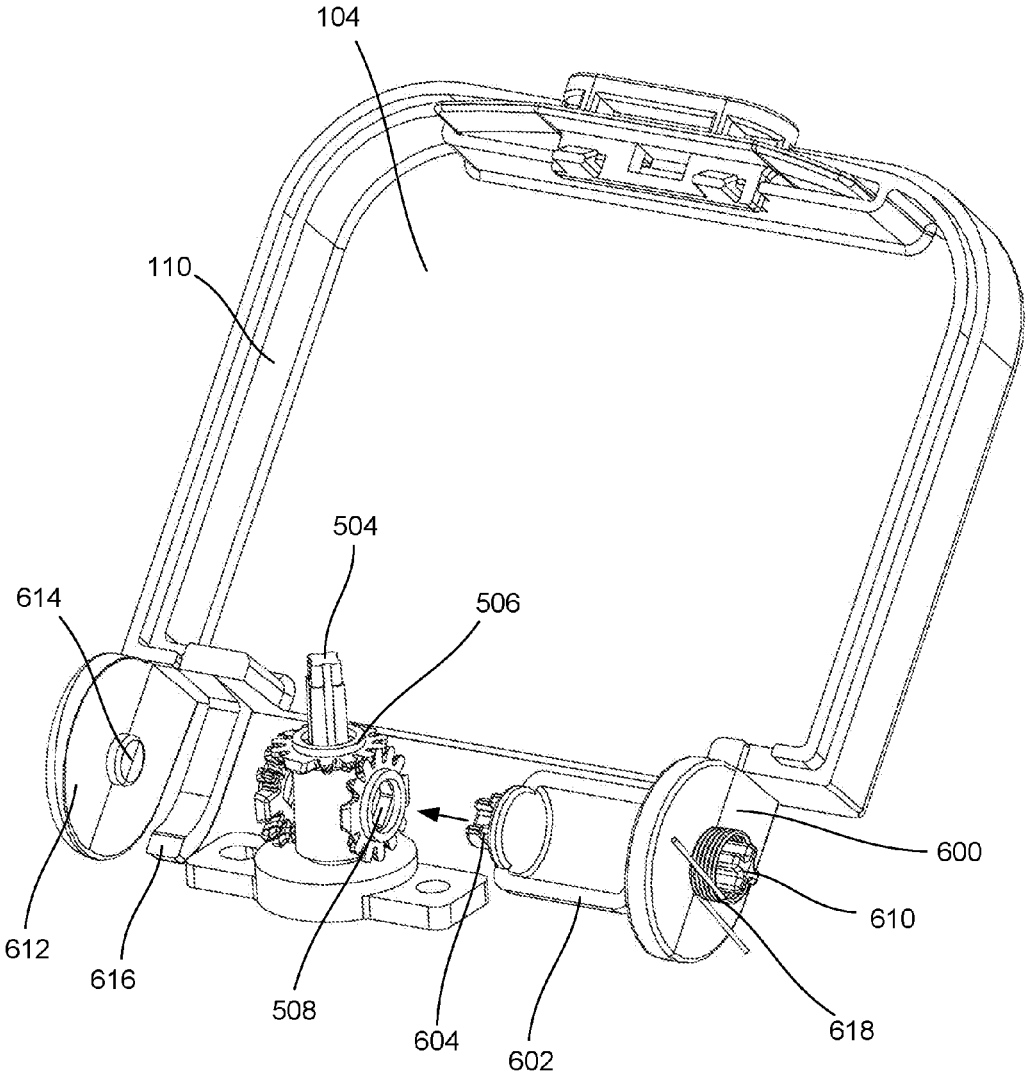
FIG. 7 depicts the insertion of a lid's inward axle extension into a lid gear.

FIG. 6 depicts a side view of an exemplary embodiment of a lid 104. As discussed above, lid gears 508 in the rotational mechanism 108 can be coupled with components of the lids 104. In some embodiments, each lid 104 can have a first axle protrusion 600 that extends from a bottom or side edge of the lid 104. An inward axle extension 602 can extend from the first axle protrusion 600 substantially parallel with the bottom edge of the lid 104. The inward axle extension 602 can have a notched end 604 that can be inserted into a center opening in a lid gear 508, as shown in FIG. 7. Due to the interaction between the inward axle extension's notched end 604 and the lid gear 508, rotation of the inward axle extension 602 when the lid 104 is opened or closed can drive rotation of the lid gear 508. In some embodiments the inward axle extension 602 can have a narrow portion 606 and a wide portion 608. The narrow portion 606 can be dimensioned to fit into a side slot 404 in the upper base housing 102*a*, while the wide portion 608 can be wider than the side slot 404 such that the wide portion 608 is retained within the interior of the base 102.

In some embodiments a light assembly, such as an LED, a battery, and/or wiring, can be coupled with the lid 104, such as on or within the wide portion 608 of the lid's inward axle extension 602. The light assembly can be configured to illuminate when the ring box 100 is at least partially opened. Because the wide portion 608 can be held within the base 102, between the upper base housing 102*a* and lower base housing 102*b*, illumination of the wide portion's LED can illuminate the base 102 from within. In alternate embodiments, the light assembly can be absent, or can be located elsewhere in the base 102, lids 104, or ring holder 106.

An outward axle extension 610 that can also extend out of the first axle protrusion 600 substantially parallel with the bottom edge of the lid 104, in a direction opposite to that of the inward axle extension 602. The outward axle extension 610 can be configured to rotationally couple with an axle connection 408 in an end wall 406 of the lower base housing 102*b*, thereby allowing rotation of the lid 104 relative to the base 102.

Each lid 104 can also have a second axle protrusion 612. The second axle protrusion 612 can extend from a bottom or side edge of the lid 104. In some embodiments, the second axle protrusion 612 can extend from a lower corner of the lid 104, while the first axle protrusion can extend from a position inward from the other lower corner of the lid 104, as shown in FIG. 6. The second axle protrusion 612 can have a nub 614 that can be rotationally coupled with an axle connection 408 in an end wall 406 of the lower base housing 102*b*, thereby allowing rotation of the lid 104 relative to the base 102.

Figure 8:
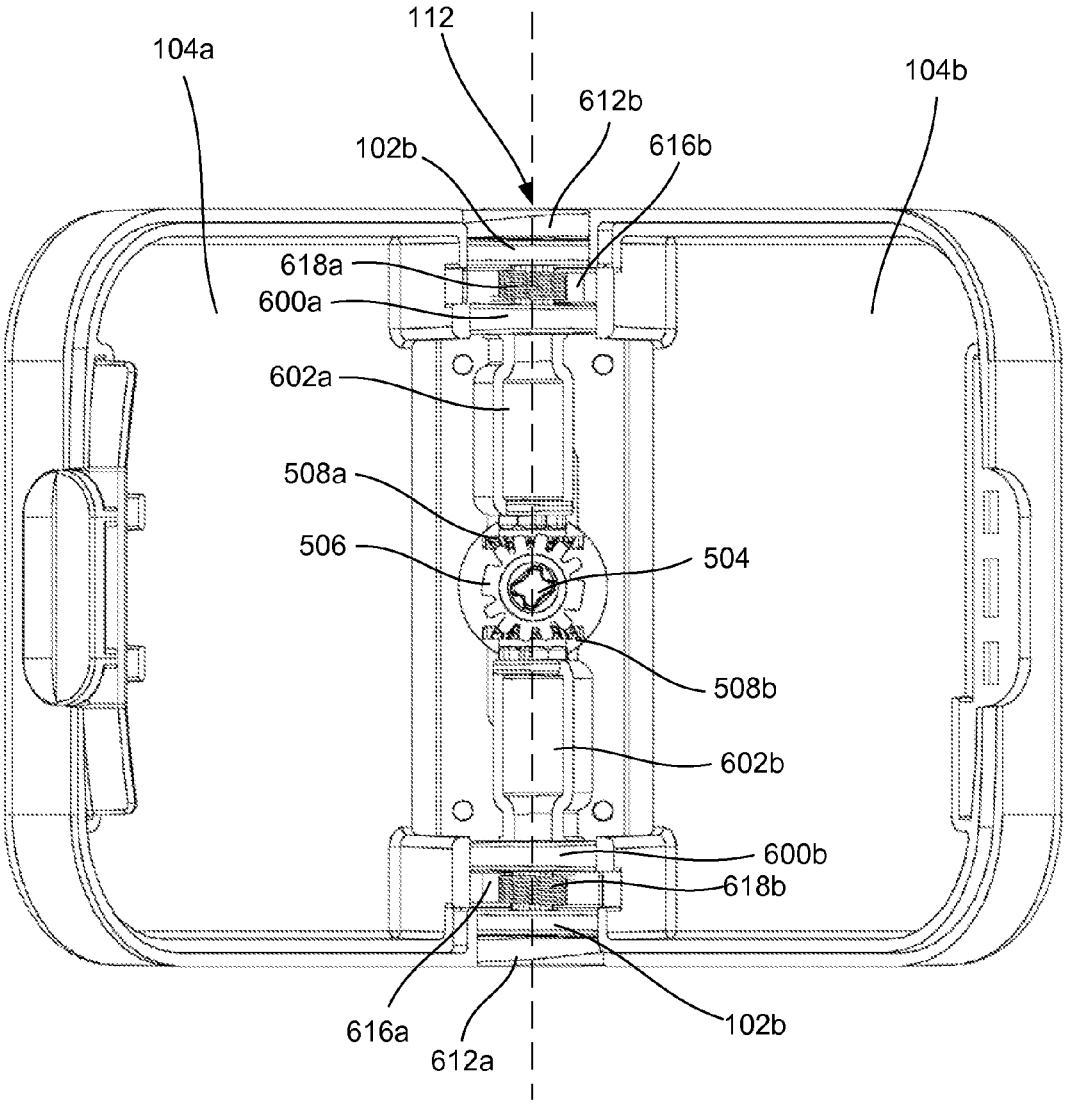
FIG. 8 depicts a top view of a partially opened ring box.

As shown in FIG. 8, the connections between the base 102, rotational mechanism 108, and lids 104 can form an axle joint 112 along an axis running through the base 102. By way of a non-limiting example, the axle joint 112 can run through: the second axle protrusion 612*a* of a first lid 104*a*; an end wall 406 of the lower base housing 102*b* through an axle connection 408; the second lid's outward axle extension 610*b*; the second lid's axle protrusion 600*b*; the second lid's inward axle extension 602*b*; a lid gear 508*b* coupled with the inward axle extension 602*b*; a lid gear 508*a* coupled with the inward axle extension 602*a* of the first lid 104*a*; the first lid's inward axle extension 602*a*; the first lid's axle protrusion 600*a*; the first lid's outward axle extension 610*a*; an end wall 406 of the lower base housing 102*b* through an axle connection 408; and the second axle protrusion 612*b* of the second lid 104*b*. Movement of the lids 104 about the axis of the axle joint 112 can rotate the lids' inward axle extensions 602, thereby rotating the lid gears 508 and rotating the interconnected axle gear 506, which in turn rotates the axle shaft 504 and the ring holder 106 above the base.

In some embodiments, each lid 104 can also have a spring extension 616. The spring extension 616 can extend from a bottom or side edge of the lid. As shown in FIG. 6, in some embodiments the spring extension 616 can extend out from the bottom edge of the lid 104 between its first axle protrusion 600 and its second axle protrusion 600. The spring extension 616 can be shaped to at least partially curve or bend around the axis of the axle joint 112, such that it can rotate around the components of the axle joint 112.

In some embodiments, springs 618 can be wrapped around the outward axle extensions 610 of one or more of the lids 104, between the lids' axle protrusions 600 and the end walls 406 of the lower base housing 102*b*, as shown in FIGS. 7 and 8. The springs 618 can be at least partially shielded from view from outside the ring box 100 by the base's spring covers 410 and/or the spring extensions 616 of the lids 104. As the lids 104 rotate about the axis of the axle joint 112, the spring extensions 616 of the lids 104 can also rotate around the springs 618.

In some embodiments, the ends of the springs 618 can be coupled with and/or press against the interiors of the base's spring covers 410 and the spring extensions 616 of the lids 104. In these embodiments, the springs 618 can be tensioned to tend to pull or push the lids' spring extensions 616 relative to the spring covers 410 of the base 102, such that springs 618 tend to pull or push the ring box 100 into its open configuration when a locking mechanism 114 is released. In alternate embodiments the springs 618, spring covers 410, and/or spring extensions 616 can be absent and the ring box 100 can be opened manually.

Figure 9B:
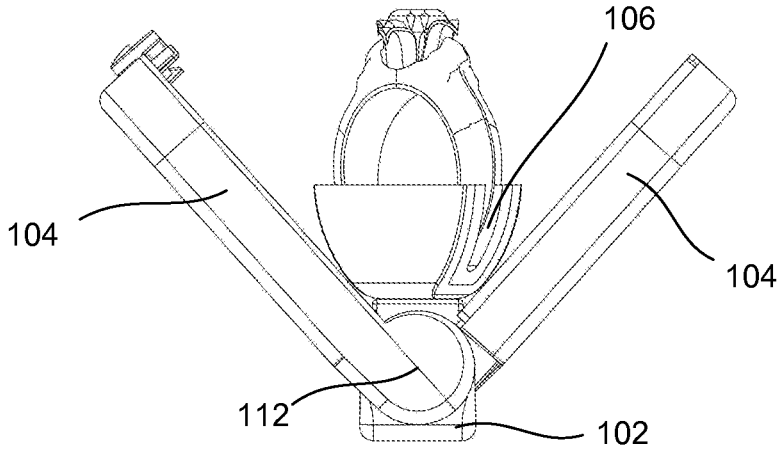
Figure 9C:
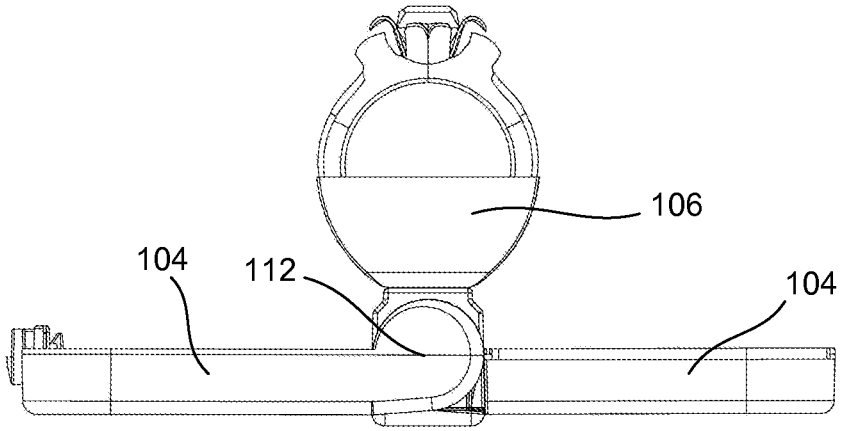

FIGS. 9A-9C depict side views of the ring box 100 moving about an axle joint 112 from a closed configuration to an open configuration, in which the ring holder 106 and a ring held by the ring holder 106 rotates by 90 degrees. In FIG. 9A, the ring can be held by the ring holder 106 within the closed ring box 100. The ring can be held substantially parallel with the sides of the lids 104 when the ring box 100 is closed. As can be seen in FIG. 9B, as the lids 104 are partially opened from the closed configuration of FIG. 9A, the action of rotating the lids 104 about the axle joint 112 can drive the rotational mechanism 108 to begin to rotate the ring holder 106 from its initial orientation to a partially turned orientation. As can be seen in FIG. 9C, when the lids 104 are fully opened 90 degrees from their closed configuration, the ring holder 106 and the inserted ring can have rotated 90 degrees from its initial orientation.

FIGS. 10A-10B and 11A-11B depict second and third exemplary embodiments of a ring box 100. In these embodiments, the base 102 can be coupled with one or more lids 104 using hinges 1002 or flexure bearings, creases, or joints at adjacent edges of the base 102 and lids 104. In the embodiment shown in FIGS. 10A-10B, the ring box 100 can comprise two lids 104 hingeably coupled with opposing edges of a substantially flat base 102. In the embodiment shown in FIGS. 11A-11B, the ring box 100 can comprise one lid 104 hingeably coupled with an edge of a lower base 102, such that the lid 104 can selectively enclose the top of the base 102 similar to a conventional ring box.

In some of these embodiments, the ring box 100 can comprise one or more joint springs 1004 that are each coupled between the lid 104 and the base 102. The joint springs 1004 can biased to tend to push or pull the lids 104 away from the base 102 to move the ring box 100 into its open configuration from its closed configuration when the locking mechanisms 114 are disengaged. In other embodiments, the joint springs 1004 can be absent and the ring box 100 can be manually opened or closed.

Figure 12:
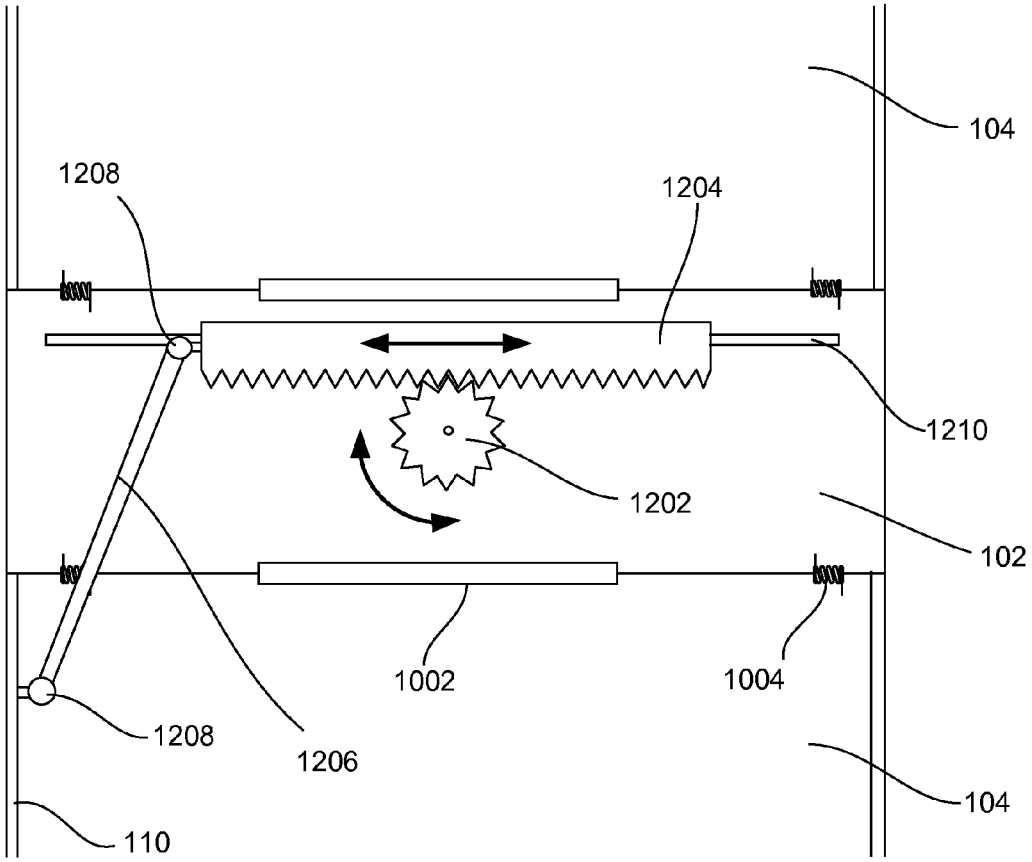
FIG. 12 depicts an alternate embodiment of a rotational mechanism.

FIG. 12 depicts an embodiment of a rotational mechanism 108 that can be used with the embodiments of FIGS. 10A-10B and 11A-11B. In these embodiments, the rotational mechanism 108 can comprise a pinion 1202, a rack 1204, and an arm 1206.

The pinion 1202 can be a toothed gear rotationally coupled with the base 102. The ring holder 106 can be coupled with the pinion 1202 such that the ring holder 106 rotates along with the pinion 1202. The ring holder 106 can be mounted on the pinion 1202, such that the ring holder 106 can rotate as the pinion 1202 rotates. In some embodiments, the ring holder 106 can be directly mounted on the pinion 1202. In alternate embodiments, the ring holder 106 can be mounted on an intermediate stand, leg, or other member that is mounted on the pinion 1202, such that the ring holder 106 is elevated above the pinion 1202.

In some embodiments the rack 1204 can be a bar with teeth configured to interact with teeth on the pinion 1202. The rack 1204 can be coupled with a track, guides, grooves, or other connectors on the base 102, such that the rack 1204 can move linearly along the base 102 substantially parallel to the length of the base 102. By way of a non-limiting example, the rack 1204 can have legs notched into a groove 1210 in the base 102, such that the rack 1204 can slide along the groove 1210, as shown in FIG. 12. The interaction between the rack 1204 and the pinion 1202 can translate linear movement of the rack 1204 into rotational movement of the pinion 1202. In alternate embodiments, the rack 1204 can be a threaded rod with threads configured to interact with the pinion's teeth as the rod rotates.

The arm 1206 can be a bar, rod, or shaft that extends between a position on a lid 104 and the rack 1204. By way of a non-limiting example, one end of the arm 1206 can be coupled to an end of the rack 1204, and the opposing end of the arm 1206 can be coupled to the inside of a side wall 110 of a lid 104, as shown in FIG. 12. In some embodiments, the arm 1206 can be coupled with the lid 104 and the rack 1204 with ball joints 1208, such that the arm 1206 can be rotated and/or moved in three dimensions between, and relative to, the lid 104 and the rack 1204. In other embodiments, the arm 1206 can be coupled with the rack 1204 and/or lid 104 with hinges, bearings, or any other joint.

Figure 13A:
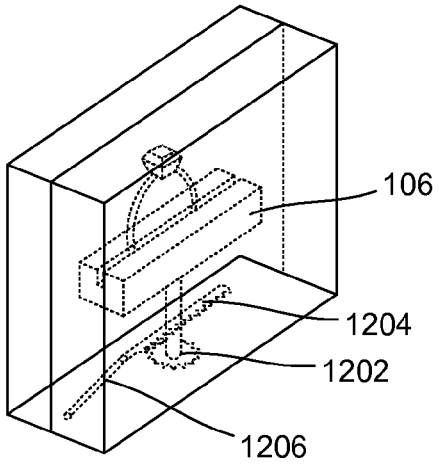
FIGS. 13A-13C depict the progression of an alternate embodiment of a ring box as it is opened from a closed configuration to an open configuration.
Figure 13B:
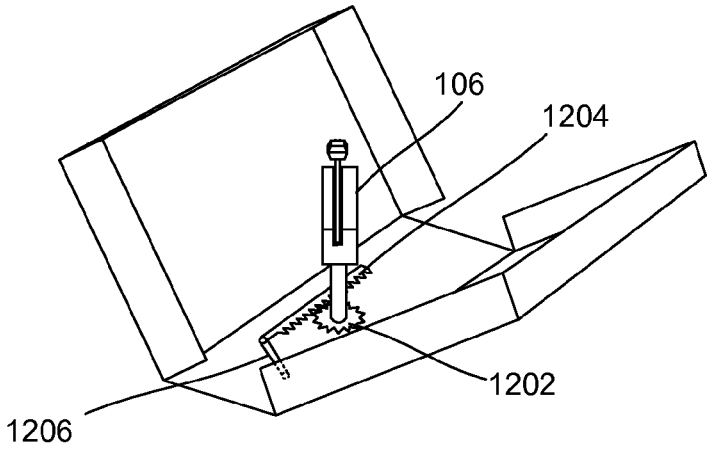
Figure 13C:
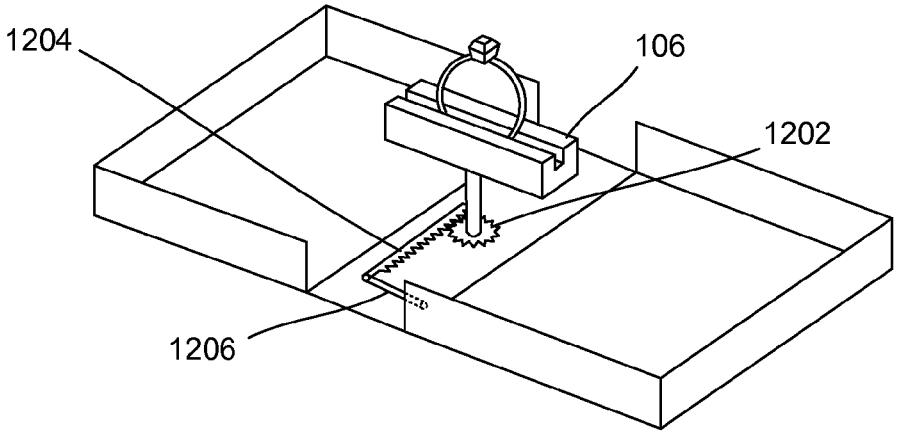

Movement of a lid 104 relative to the base 102 during opening or closing of the ring box 100 can drive linear movement of the rack 1204, which in turn can drive rotational movement of the pinion 1202 and the ring holder 106. By way of a non-limiting example, FIGS. 13A-13C depict the progression of an embodiment of the ring box 100 as it is opened from a closed configuration to an open configuration. When the ring box 100 is in the closed configuration of FIG. 13A, the rack 1204 can be positioned substantially on the side of the base 102 farthest from the point at which the arm 1206 is coupled with the side wall 110 of the lid 104. As the ring box 100 is opened toward the opened configuration, the lid 104 can be moved relative to the base 102 about a hinge 1002, and this movement of the lid 104 can pull the end of the arm 1206 coupled with the lid 104. The opposite end of the arm 1206 can in turn pull the rack 1204 along its linear path on the base 102, with the linear movement of the rack 1204 translating into rotational movement of the pinion 1202 and the ring holder 106 coupled with the pinion 1202.

Similarly, as the ring box 100 is closed, movement of the lid 104 toward its closed position can drive the arm 1206 to push the rack 1204 linearly back to its initial position, which in turn can rotate the pinion 1202 and ring holder 106. The ball joints can allow the arm 1206 to move in three dimensions and continue to extend between the rack 1204 and an anchor point on the lid 104 while the lid 104 and rack 1204 move relative to one another.

Figure 14A:
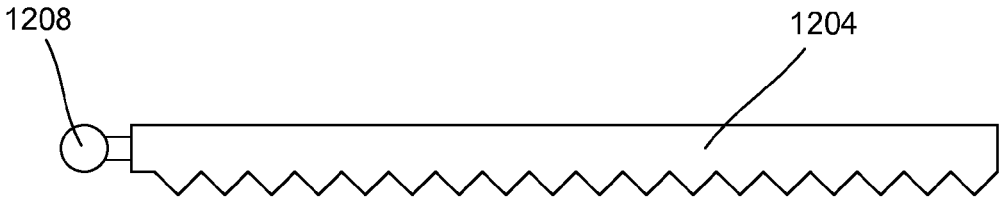
FIG. 14A depicts a first embodiment of a rack.
Figure 14B:
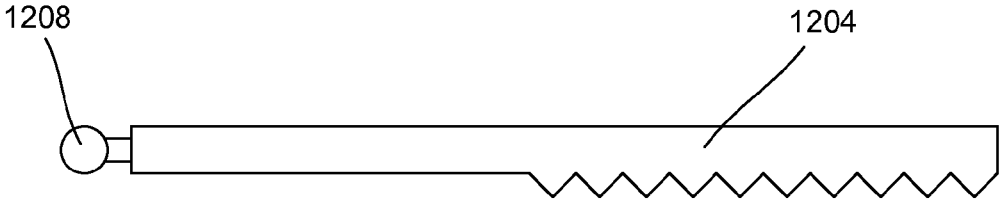
FIG. 14B depicts a second embodiment of a rack.

In some embodiments, the rack 1204 can have teeth or threads along substantially the entire length of the rack 1204, as shown in FIG. 14A. In these embodiments, linear movement of the rack 1204 can drive rotational movement of the pinion 1202 and ring holder 106 as soon as the rack 1204 begins to move. In other embodiments, the rack 1204 can have teeth or threads along a portion of the length of the rack 1204 with the remainder being smooth, as shown in FIG. 14B. In these embodiments, the smooth portion of the rack 1204 can slide past the pinion 1202 without engaging the pinion's teeth or causing rotational movement of the pinion 1202 and the ring holder 106 until the toothed portion of the rack 1204 reaches and engages the teeth or threads of the pinion 1202. By way of a non-limiting example, the teeth of the rack 1204 can be configured to engage the pinion 1202 once the ring box 100 has been opened halfway and the arm 1206 has pulled the rack 1204 partially along its linear path, such that rotation of the ring holder 106 begins after the ring box 100 has been opened far enough for a viewer to sufficiently see into the ring box 100 and perceive the ring holder 106 and/or ring held by the ring holder 106.

In some embodiments, the teeth of the pinion 1202 and/or rack 1204 can be evenly sized and/or spaced, such that constant linear movement of the rack 1204 drives rotation of the pinion 1202 and ring holder 106 at a constant rate. In alternate embodiments, the teeth of the pinion 1202 and/or rack 1204 can be unevenly sized and/or spaced, such that constant linear movement of the rack 1204 drives rotation of the pinion 1202 and ring holder 106 at a variable or uneven rate. By way of a non-limiting example, the teeth of the rack 1204 can be spaced progressively closer together from one side of the rack 1204 to the other, such that movement of the rack 1204 causes the speed of the rotation of the pinion 1202 and ring holder 106 to increase as the ring box 100 moves from the closed configuration toward the open configuration and teeth on the rack 1204 that are progressively closer together are engaged with the teeth of the pinion 1202. In alternate embodiments, the teeth of the pinion 1202 can be unevenly sized and/or spaced to lead to variable or uneven rotation rates of the pinion 1202 and ring holder 106 as the ring box 100 is opened or closed.

Figure 15:
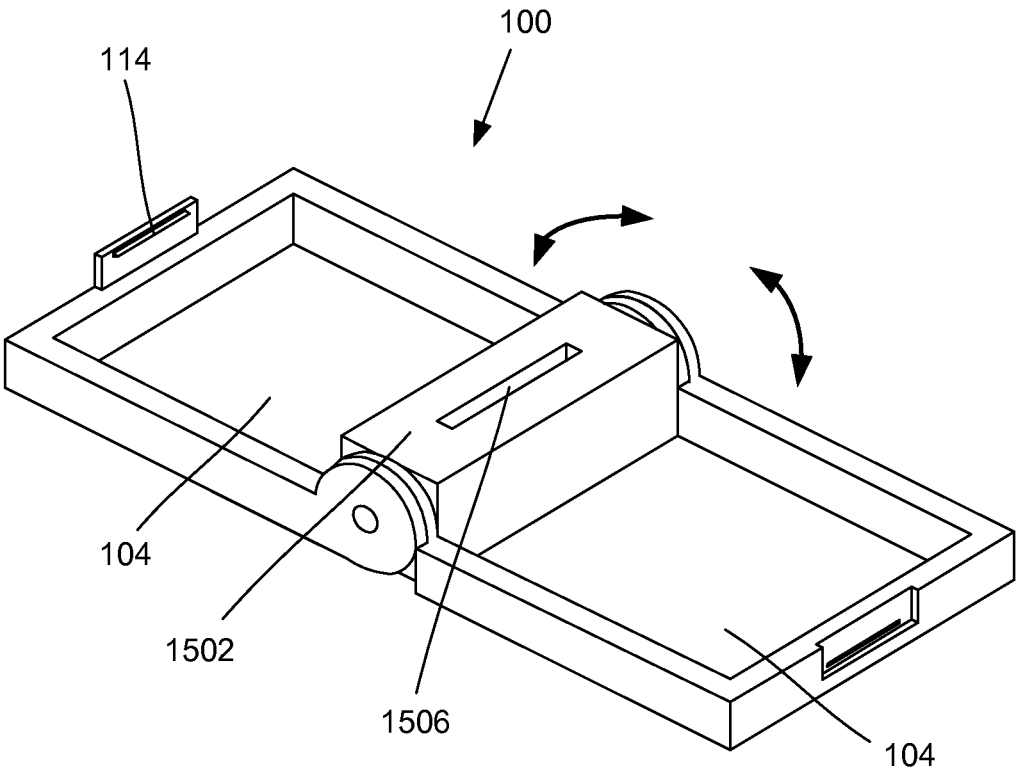
FIG. 15 depicts a fourth embodiment of a ring box.

FIG. 15 depicts an exemplary embodiment of an alternate embodiment of a ring box 100, in which one or more lids 104 are rotationally coupled with a base stand 1502 having a stationary ring holder 1506. The lids 104 can be coupled with the base stand 1502 using hinges, extending portions that connect with extensions of the base stand 1502 to form an axle, or any other rotational or flexible connection that allows the lids 104 to be rotated with respect to the base stand 1502 to open and close the ring box 100. In some embodiments, the stationary ring holder 1506 can be as a groove or slot within the base stand 1502. In other embodiments, the stationary ring holder 1506 can be any other type of ring holder 106 mounted in a fixed position on the base stand 1502. The stationary ring holder 1506 can be configured to at least partially retain a ring such that the ring is housed within the ring box 100 when the ring box 100 is closed, and such that the ring can be exposed when the ring box 100 is opened. In these embodiments, the height, width, and depth of the ring box 100 in its closed configuration can be sized such that there is not significant space between a ring held by the stationary ring holder 1506 and the interior walls of the ring box 100. By way of a non-limiting example, the depth of the base stand 1502 can be larger than, but substantially similar to the depth of a ring, and when the ring box 100 is closed the space between opposing interior faces of the lids 104 can be substantially similar to the depth of the stationary ring holder 1506, and the ring held by the stationary ring holder 1506 can be substantially parallel to the interior faces of the lids 104.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A ring box, comprising:

a base;

a first lid rotationally coupled with said base;

a second lid rotationally coupled with said base;

a rotational mechanism coupled with said base; and a ring holder coupled with said rotational mechanism, said ring holder being configured to selectively retain a ring, wherein said rotational mechanism is coupled with said first lid such that movement of said first lid relative to said base drives said rotational mechanism to rotate said ring holder, wherein said first lid and said second lid are configured to be moved relative to said base to selectively move between a closed configuration in which said ring holder is entirely enclosed within an enclosure formed by said base, said first lid, and said second lid, and an open configuration in which said first lid and said second lid are spaced apart to reveal said ring holder;

wherein portions of said base, said first lid, said second lid, and said at least one rotational mechanism form an axle joint, such that said first lid and said second lid are configured to rotate about an axis running through said axle joint relative to said base;

wherein said axle joint comprises:

a first axle protrusion extending from said first lid;

a second axle protrusion extending from said first lid;

a first wall of said base; and a second wall of said base, wherein said first axle protrusion has an inward axle extension coupled with a first lid gear of said rotational mechanism that is configured to drive rotation of said ring holder, said first axle protrusion has an outward axle extension rotationally coupled with said first wall of said base, and said second axle protrusion is rotationally coupled with said second wall of said base.

2. The ring box of claim 1, wherein said first lid and said second lid are positioned on opposing sides of said base.

3. The ring box of claim 1, wherein the space between interior faces of said first lid and said second lid when said first lid and said second lid are in said closed configuration is substantially similar to the depth of said ring holder.

4. The ring box of claim 1, further comprising a locking mechanism configured to selectively maintain said first lid and said second lid in said closed configuration.

5. The ring box of claim 1, wherein said rotational mechanism comprises a pedestal coupled with said base, an axle shaft rotationally coupled with said pedestal, said axle shaft being coupled with said ring holder, an axle gear coupled with said axle shaft, and a lid gear configured to drive said axle gear, wherein said lid gear is coupled with said first lid such that movement of said first lid drives said lid gear and thereby rotates said axle shaft and said ring holder.

6. The ring box of claim 1, further comprising one or more springs coupled between said base and said first lid and said second lid, said one or more springs being tensioned to move said first lid and said second lid toward said open configuration.

7. The ring box of claim 1, wherein said base comprises an upper base housing and a lower base housing that together enclose portions of said axle joint.

8. The ring box of claim 1, further comprising a spring surrounding said outward axle extension, said spring having a first end coupled with a spring extension extending from said at least one lid and a second end coupled with a spring cover of said base, wherein said spring is tensioned to move said first lid relative to said base toward said open configuration.

9. The ring box of claim 1, wherein said rotational mechanism is further coupled with said second lid such that movement of said second lid relative to said base drives said rotational mechanism to rotate said ring holder.

10. The ring box of claim 9, wherein said axle joint further comprises portions of said second lid.

11. The ring box of claim 10, wherein said second lid is coupled with a second lid gear of said rotational mechanism that is configured to drive rotation of said ring holder.

12. The ring box of claim 11, wherein said first lid gear and said second lid gear are interconnected with an axle gear of said rotational mechanism, such that movement of said first lid gear drives rotation of said axle gear and said second lid gear, and movement of said second lid gear drives rotation of said axle gear and said first lid gear.

* * * * *